US008333490B2

(12) United States Patent
Wu

(10) Patent No.: US 8,333,490 B2
(45) Date of Patent: Dec. 18, 2012

(54) FIREPROOF LIGHT FIXTURE

(76) Inventor: Liangju Wu, Foshan (CN)

( * ) Notice: Subject to any disclaimer, the term of this patent is extended or adjusted under 35 U.S.C. 154(b) by 401 days.

(21) Appl. No.: 12/673,411

(22) PCT Filed: Jul. 3, 2008

(86) PCT No.: PCT/CN2008/001263

§ 371 (c)(1),
(2), (4) Date: Feb. 12, 2010

(87) PCT Pub. No.: WO2009/006786

PCT Pub. Date: Jan. 15, 2009

(65) Prior Publication Data

US 2010/0214790 A1 Aug. 26, 2010

(30) Foreign Application Priority Data

Jul. 5, 2007 (CN) ..... 2007 2 0053889 U
Jul. 26, 2007 (CN) ..... 2007 2 0054955 U

(51) Int. Cl.
*F21V 15/00* (2006.01)
*F21V 17/00* (2006.01)
*F21S 8/00* (2006.01)

(52) U.S. Cl. ..... 362/364; 362/147; 362/148; 362/150; 362/365

(58) Field of Classification Search ..... 362/147, 362/364, 365, 366, 404, 148, 150
See application file for complete search history.

(56) References Cited

U.S. PATENT DOCUMENTS

| | | | | |
|---|---|---|---|---|
| 6,357,891 | B1 * | 3/2002 | Newbold et al. | 362/147 |
| 7,470,048 | B2 * | 12/2008 | Wu | 362/364 |
| 7,651,238 | B2 * | 1/2010 | O'Brien | 362/148 |
| 2010/0265718 | A1 * | 10/2010 | Wu | 362/294 |

FOREIGN PATENT DOCUMENTS

| | | |
|---|---|---|
| CN | 2771649 | 4/2006 |
| CN | 1969146 | 5/2007 |
| CN | 200940797 | 8/2007 |
| CN | 201014386 | 1/2008 |
| CN | 201050758 | 4/2008 |
| CN | 201072101 | 6/2008 |
| GB | 2436139 | 9/2007 |
| TW | 296340 | 8/2006 |

OTHER PUBLICATIONS

International Search Report of CN/2008/001263, dated Oct. 23, 2008.

* cited by examiner

*Primary Examiner* — Stephen F Husar
*Assistant Examiner* — James Cranson, Jr.
(74) *Attorney, Agent, or Firm* — Hamre, Schumann, Mueller & Larson, P.C.

(57) ABSTRACT

A fireproof lamp, comprises a barrel cover (2) and a lamp holder (4) installed therein. A through hole (6) is provided on the barrel cover (2). A pipe (5) is installed in the through hole (6), and an electric wire connected with the lamp holder (4) is connected to a junction box (8) outside of the barrel cover (2). An expansion fireproof material (9) is provided inside the barrel cover (2).

13 Claims, 1 Drawing Sheet

FIREPROOF LIGHT FIXTURE

BACKGROUND OF THE INVENTION

The present invention relates to a light fixture, and in particular to a fireproof light fixture.

In the modern house decoration, some recessed light fixtures are usually installed in the walls of the ceiling, furniture, etc. In order to prevent fire from spreading when on fire, wall plates at these positions consist of fireproof plates. However, when mounting the recessed light fixtures, holes have to be made on the fireproof plate. Normally, the recessed light fixture is not fireproof, and there is a risk that fire may spread through these recessed light fixtures. Moreover, in the known cylindrical recessed light fixture, at least the top of the mantle is made of aluminum so as to enable the mantle to have a better property in heat dispersion, but as is known in the art, aluminum has a relative low melting point. When there is a fire, the top of the mantle which is made of aluminum will be burnt out and thus the fire will spread into the ceiling, and serious damages will be caused.

Therefore, the recessed light fixtures should comply with the safety standard and fire resistance requirements. US fire resistance standard UL263 gives the fire resistance requirements of the floor, ceiling and other architectural components, as well as the recessed light fixtures used in the building. The Chapter 15 of UL1598, US safety standard of light fixtures, specifies the working temperature of light fixtures: in the case of the heat protector does not work, the light fixture contacted with the heat insulator or test box shall not exceed 90° C. within 3 hours; in the case of the heat protector works, the light fixture contacted with the heat insulator or test box shall not exceed 160° C. within 3 hours. Temperature controller may be provided in the light fixture to controlling the temperature, and when exceeding the standard temperature range, the light fixture turns off itself. Thus, it is desirable to obtain a light fixture with good fire resistance property which complies with both the safety standard and fire resistance standard, and also has a good result in heat dispersion to maintain the temperature of fixture and ensure excellent working property.

Accordingly, it is necessary to provide a fireproof light fixture which has suitable structure and good fire resistance property.

SUMMARY OF THE INVENTION

Having the state of the prior art and its attendant shortages, it is an object of the present invention to provide a fireproof light fixture which has suitable structure and good fire resistance property.

It is a further object of the present invention to provide a fireproof light fixture which has suitable structure and good fire resistance property and also allow the effective heat dispersion of the light fixture so as to maintain a relative low temperature of light fixture and comply with the temperature requirement and the safety standard.

The above object of the present invention is achieved by the following technical solutions:

A fireproof light fixture comprises: a mantle having a through hole thereon; a lamp holder mounted in the mantle; electrical wires extending through the through hole and connected between the lamp holder and a junction box outside of the mantle; and a dilatable fireproof piece mounted in the mantle. The dilatable fireproof piece may be fixed on the inner surface of the mantle.

According to a preferred embodiment, a bracket is mounted in the mantle, and the lamp holder is fixed below the bracket. The dilatable fireproof piece is fixed on the inner surface of the mantle and/or the surface of the bracket.

The mantle is made of metallic materials. Taking into consideration of the heat dispersion and cost, the aluminum plate is normally used. When the dilatable fireproof piece mounted on the inner surface of the mantle encounter a fire, it will dilate to forma thick piece of carbide to realize the fire resistance and heat insulation and also to prevent the aluminum plate from melting.

According to a further preferred embodiment, the mantle comprises a side plate and a top plate which are separately formed and then connected with each other, the top plate is made of aluminum, and the side plate is made of heat resistant metallic material such as iron, steel, and copper. Taking into consideration of the cost, the side plate is normally made of iron. A dilatable fireproof piece is fixed on the inner surface of the top plate of the mantle. In the light fixture with a bracket mounted in the mantle, the dilatable fireproof piece is fixed on the inner surface of the mantle and/or the top surface of the bracket. Thus, the light fixture is fire resistant, while the top plate is prevented from melting, the aluminum plate reduces the temperature inside the light fixture effectively, and it can meet the requirement of temperature controlling inside the light fixture.

To facilitate the mounting of the light fixture to the ceiling, the light fixture further comprises a supporting plate, and the mantle is mounted on the supporting plate. A fireproof piece and/or a dilatable fireproof piece are mounted in a gap between the supporting plate and the mantle. Preferably, a fireproof piece and/or a dilatable fireproof piece are fixed on the surface of supporting plate.

The dilatable fireproof piece is preferably a highly dilatable fireproof piece.

Comparing with the light fixture in prior art, the present invention has the following advantages:

By mounting a dilatable fireproof piece inside the mantle, preferably on the inner surface of the mantle and/or the surface of the bracket, the dilatable fireproof piece will dilate to form a thick piece of carbide which covers on the bracket or the inner surface of the mantle to realize the fire resistance and heat insulation and thus to prevent the fire from spreading. Furthermore, the mantle comprises a side plate made of heat resistant metallic material and a top plate made of aluminum, which can improve the heat dispersion rate and enable the temperature of the light fixture to remain in a certain range. In addition, the dilatable fireproof piece is fixed on the top plate or the bracket, and thus when on fire, the dilatable fireproof piece will dilate to forma thick piece of carbide to effectively prevent the top plate from melting, and the light fixture of the present invention will be more safe in use.

BRIEF DESCRIPTION OF THE DRAWINGS

Many aspects of the invention can be better understood in the following embodiments with reference to the accompanying drawings, wherein.

DETAILED DESCRIPTION OF THE PREFERRED EMBODIMENT

Figure 1:
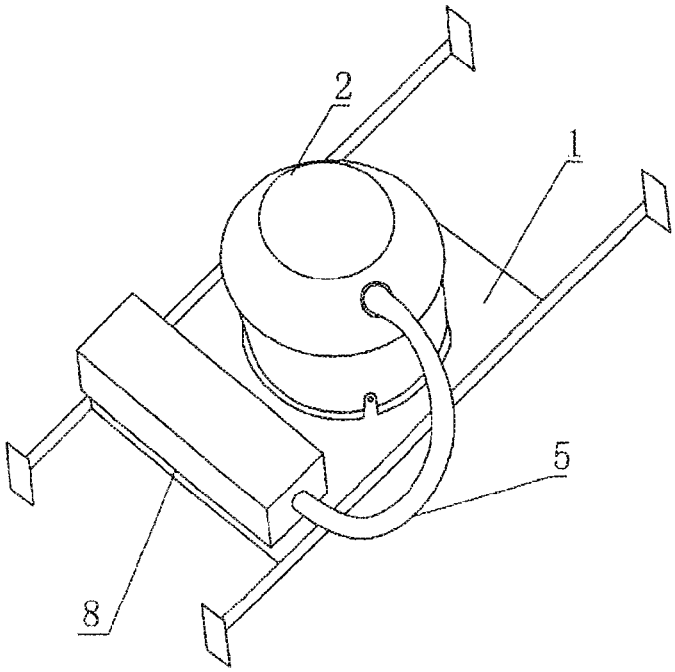
FIG. 1 is a schematic perspective view of a light fixture according to an embodiment of the present invention.
Figure 2:
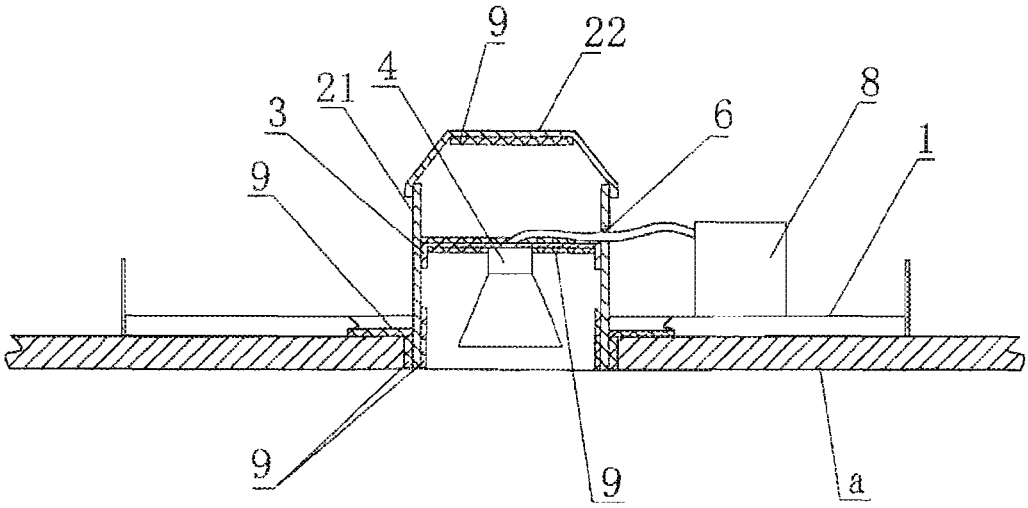
FIG. 2 is a light fixture in use according to an embodiment of the present invention.

Referring to FIGS. 1 and 2, a fireproof light fixture comprises a supporting plate 1 and a mantle 2 mounted on the supporting pate 1. A bracket 3 is mounted inside the mantle 2, and a lamp holder 4 is fixed below the bracket 3. The mantle 2 is provided with a through hole 6, a pipe extends through the through hole 6. Electrical wires extending through the pipe 5 are connected between the lamp holder 4 and a junction box 8 outside of the mantle 2. A dilatable fireproof piece 9 mounted in the mantle 2.

Referring to FIG. 2, the dilatable fireproof piece 9 is fixed on the inner surface of the mantle 2 and the surface of the bracket 3. The "a" represents the ceiling; the light source is mounted on the lamp holder 4. When on fire, the dilatable fireproof piece 9 dilates to form a thick piece of carbide which then covers on the bracket 3 or the mantle 2 to realize the fire resistance and heat insulation, the temperature outside the light fitting will not be too high, and fire will be prevented from burning out the top of the mantle 2 and spreading into the ceiling. The present invention has a suitable structure and is safer to use.

Furthermore, the dilatable fireproof piece 9 is mounted on the inner surface of the mantle 2 and/or the surface of the bracket 3 via connecting elements.

Alternatively, the bracket 3 may be the top of the mantle 2. The lamp holder 4 is then directly mounted on the bracket 3, which is equivalent to that the light holder 4 is mounted on the top of the mantle 2.

The mantle 2 made of metallic materials comprises a side plate 21 and a top plate 22 which are separately formed and connected with each other. The side plate 21 is made of iron, and the top plate 22 is made of aluminum. The light fitting has better property in heat dispersion since the top plate 22 is made of aluminum. The dilatable fireproof piece 9 is fixed on the inner surface of the top 22 of the mantle 2 and/or the top surface of the bracket 3. Thus, the light fixture is fire resistant, while the top plate 22 is prevented from melting, the aluminum plate reduces the temperature inside the light fixture effectively, and it can meet the requirement of temperature controlling inside the light fixture.

Preferably, a dilatable fireproof piece 9 is fixed on the surface of supporting plate 1, which further improves the fire resistance property.

When there is a gap between the supporting plate 1 and the mantle 2, a dilatable fireproof piece 9 may be mounted in the gap. Therefore, fire will be prevented from spreading through this gap, which further improves the safety for using the light fitting.

In addition, the dilatable fireproof piece 9 is preferably a highly dilatable fireproof piece The present invention has a suitable structure and better fire resistance property, and can thus be used in various areas.

It should be emphasized that the above-described embodiments of the present invention, particularly, any preferred embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A fireproof light fixture, comprising:

a mantle having a through hole thereon;

a lamp holder mounted in the mantle;

electrical wires extending through the through hole and connected between the lamp holder and a junction box outside of the mantle; and a dilatable fireproof piece mounted in the mantle, wherein the mantle comprises a side plate and a top plate connected with each other, the side plate is made of heat resistant metallic material, and the top plate is made of aluminum.

2. The fireproof light fixture of claim 1, wherein the dilatable fireproof piece is fixed on the inner surface of the mantle.

3. The fireproof light fixture of claim 1, wherein the dilatable fireproof piece is fixed on the inner surface of the top plate of the mantle.

4. The fireproof light fixture of claim 1, wherein the heat resistant material includes iron, steel, and copper.

5. The fireproof light fixture of claim 1, wherein a bracket is mounted in the mantle, and the lamp holder is fixed below the bracket.

6. The fireproof light fixture of claim 5, wherein the dilatable fireproof piece is fixed on the inner surface of the mantle and/or the surface of the bracket.

7. The fireproof light fixture of claim 5, wherein the dilatable fireproof piece is fixed on the inner surface of the top plate of the mantle or on the top surface of the bracket.

8. The fireproof light fixture of claim 1, wherein the light fixture further comprises a supporting plate, and the mantle is mounted on the supporting plate.

9. The fireproof light fixture of claim 8, wherein a fireproof piece and/or a dilatable fireproof piece is mounted in a gap between the supporting plate and the mantle.

10. The fireproof light fixture of claim 8, wherein a fireproof piece and/or a dilatable fireproof piece is fixed on the surface of supporting plate.

11. The fireproof light fixture of claim 1, wherein the dilatable fireproof piece is a highly dilatable fireproof piece.

12. The fireproof light fixture of claim 1, wherein the top plate and the side plate define an interior space, the top plate has an inner surface downwardly facing the interior space, and the dilatable fireproof piece is mounted on the inner surface of the top plate and has a major surface downwardly facing and exposed to the interior space.

13. The fireproof light fixture of claim 12, wherein when the fireproof light fixture is on fire, the dilatable fireproof piece dilates to form a layer of carbide to cover the inner surface of the top plate.

* * * * *